United States Patent [19]

Paules

[11] 4,067,172

[45] Jan. 10, 1978

[54] CARTON SET-UP AND LOADING MACHINE

[75] Inventor: Eugene H. Paules, Red Lion, Pa.

[73] Assignee: ExCel Engineering, Inc., Red Lion, Pa.

[21] Appl. No.: 763,645

[22] Filed: Jan. 28, 1977

[51] Int. Cl.[2] ..... B65B 57/06; B65B 43/28

[52] U.S. Cl. ..... 53/53; 53/55; 53/63; 53/186; 53/258; 53/374

[58] Field of Search ..... 53/53, 55, 63, 131, 53/186, 250, 258, 374

[56] References Cited

U.S. PATENT DOCUMENTS

| | | | |
|---|---|---|---|
| 2,116,895 | 5/1938 | Howard | 53/53 X |
| 2,831,300 | 4/1958 | Schroeder | 53/63 |
| 2,923,112 | 2/1960 | Harker | 53/186 X |
| 2,999,344 | 9/1961 | Clanin et al. | 53/186 |
| 3,390,509 | 7/1968 | Kamp | 53/258 X |
| 3,884,015 | 5/1975 | Melton | 53/131 |

*Primary Examiner*—Travis S. McGehee

*Attorney, Agent, or Firm*—C. Hercus Just

[57] ABSTRACT

A carton set-up and loading machine including a magazine for a stack of flattened cartons, suction cups to pull lowermost carton onto one end of a conveyor having spaced perpendicular blades forming compartments to receive a flattened carton and, as traveling around a sprocket, the blades move from diverging to parallel relation to set-up the carton, cam and rotatable members fold side and one end flap at one end closed to receive products from a lateral guideway while conveyor is momentarily stopped. Additional cams and rotatable means fold the side and one end flap at other end of carton closed followed by adhesive being applied to outer end flaps at both ends of carton and pivoted power-operated plates close the same against the previously folded flaps to complete the package. Overall sensing and safety controls insure no jams or unfilled cartons from occurring. Weighing means to prevent short weight also are included.

18 Claims, 19 Drawing Figures

CARTON SET-UP AND LOADING MACHINE

BACKGROUND OF THE INVENTION

This invention pertains to the setting up of flattened cartons so as to be rectangular in cross-section from flattened condition, the cartons having side and end flaps projecting from all four edges at each end of the cartons. The cartons are moved onto a conveyor incident to being set up. The flaps at one end of the carton are closed to form a bottom and loading mechanism injects one or more articles into the opposite open end of the carton, followed by folding the flaps at the open end closed and then discharging the filled and closed cartons from the machine.

Various types of mechanisms have been devised heretofore for accomplishing some or most of the foregoing operations in various ways. Some of these machines are relatively complex and, as will be seen hereinafter, it is the principal object of the present invention to provide a relatively simple and foolproof machine to accomplish the foregoing operations.

To provide additional background for the invention, certain exemplary U.S. patents have been selected to illustrate features of machines which, in general, perform some of the foregoing operations and effect closed cartons which are secured in various ways. The aforementioned exemplary patents are as follows:

U.S. Pat. No. 3,037,431, to McGihon, dated June 5, 1962 has mechanism to set up flattened cartons by a short, independent conveyor provided with fingers operated by linkage, which effect an initial partial set up of the carton and, as the fingers move over the discharge end of said conveyor, they transfer the partially set up cartons to a main conveyor which has perpendicular blades which complete the set up of the cartons, followed by insertion of cans and the like into the opposite open ends of the carton, after which flaps on the carton are folded into closed condition.

U.S. Pat. No. 3,088,257, to Penley, dated May 7, 1963, pertains to a machine for filling boxes already set up in rectangular condition and the flaps thereon open at opposite ends. Curved cams fold the ends of the end flaps over curved bars to insert the folded ends into the box so that no adhesive is required and flexible fingers with packets between the same push the packets into the carton and a plunger pushes the packets from between the fingers, followed by the ends of the carton being closed.

U.S. Pat. No. 3,509,681, to Sass, dated May 5, 1970, pertains to a machine in which receptacles on a conveyor hold products to be packaged by insertion into one of the cartons carried by a separate conveyor. Flaps on the ends of the cartons are closed by cam members and other means of relatively complex nature.

U.S. Pat. No. 3,613,526, to Jones, dated Oct. 19, 1971, pertains to a machine having upper and lower suction cups to engage respectively the opposite walls of a flat carton to set it up into substantially rectangular condition and a conveyor having forward and rearward lugs supports the set up cartons for movement to loading mechanism.

SUMMARY OF THE INVENTION

It is one of the principal objects of the present invention to provide a relatively simple and somewhat streamlined machine having a magazine at one end for holding a supply of flattened cartons from the opposite ends of which flaps project from all four edges, said magazine being disposed above one end of a flexible conveyor having compartment-forming blades projecting vertically therefrom in longitudinally spaced relationship, said conveyor extending around sprockets at opposite ends of the conveyor, and suction means project against the lowermost carton in the magazine and pull the same onto the adjacent end of the conveyor in a manner by which a pair of successive blades are in diverging relationship as they move around the sprocket and upon reaching the straight portion of the path of the conveyor, said blades are parallel to each other and thereby cause each carton to be set up into rectangular position in cross-section and said blades also maintaining said carton in said set up position.

It is another object of the invention to provide a first set of cams adjacent one side of the conveyor downstream from the magazine which operates to fold one side flap into closed position while a rotatable member folds the other side flap into closed position, followed by a cam which folds the bottom end flap upwardly to closed position to condition the carton to receive a wide range of different types of products, while the uppermost flap remains in projecting condition. A further object of the invention is to provide cam and rotatable means adjacent the opposite side of the conveyor which are operable to fold at least certain of the flaps at the opposite end of the carton into fully open position to insure ready reception of articles or material to be loaded into the carton from a laterally extending guide means with which a plunger is associated to push the items or material into the open end of the carton while the carton is momentarily stationary due to stepwise operation of the conveyor.

Still another object of the invention is to provide downstream from the loading mechanism and on the same side of said conveyor as said mechanism stationary cam and rotatable means operable to fold the opposite side flaps of the loading end of the carton into closed position and fold upwardly the bottom flap into closed position while the upper flap remains in projected condition.

One further object of the invention is to provide downstream from the aforementioned flap-folding mechanism means to apply adhesive to the under surfaces of the outwardly projecting upper flaps at opposite ends of the carton, followed by the operation of pivoted plates which are power-operated to close the upper flaps into sealing relationship with the previously folded flaps at opposite ends of the carton, followed by means to hold said outermost cemented flaps in closed position for a brief interval while the conveyor moves to the exit end thereof and discharges a loaded and sealed carton onto weight-indicating mechanism which includes weight-recording means that preferably is of a visual nature and control means associated with the weight-indicating mechanism operates to eject short weighted cartons into a suitable destination, while cartons having a satisfactory weight are discharged by the next oncoming carton onto a transfer conveyor or otherwise, which may, for example, lead to containers to receive a plurality of such loaded and sealed cartons.

As an overriding feature of the entire mechanism, sensing and control means in circuit therewith operate to insure that no damage can occur to any of the cartons or jamming of the operation of the machine can occur, as well as the loading of the mechanism not functioning unless a properly set up carton is in line therewith to receive items or material from the loading mechanism.

It is still another object of the invention to devise the machine in such manner that rather than operating with the cartons in horizontal condition and loaded from one end, the entire machine may be oriented ninety degrees about the longitudinal axis of the machine, and thereby permit the reception of granular or powdered type material into the open end of the carton by gravity.

A still further object of the invention is to mount at least certain elements of the flap-folding and closing mechanism for adjustment toward and from the conveyor, and thereby enable the machine to accommodate cartons of a reasonable range of different sizes in a vertical direction with respect to the conveyor and ancillary thereto, is still another object of the invention to arrange for the compartment-forming blades on the conveyor to be adjusted axially with respect to each other in the direction of movement of the conveyor to accommodate a range of cartons of different widths.

Details of the foregoing objects and of the invention are set forth in the following specification and illustrated in the accompanying drawings comprising a part thereof.

DETAILED DESCRIPTION OF THE DRAWINGS

FIGS. 14–19 are respective views successively illustrating the transformation of a flattened carton as received from the magazine of the machine and showing the progressive steps of folding the vertical and horizontal end flaps initially at one end of the carton to form the bottom and subsequently folding the flaps at the open end of the carton into which products are loaded and said end of the carton successively being closed by folding of the flaps thereof.

DETAILED DESCRIPTION

Figure 1:
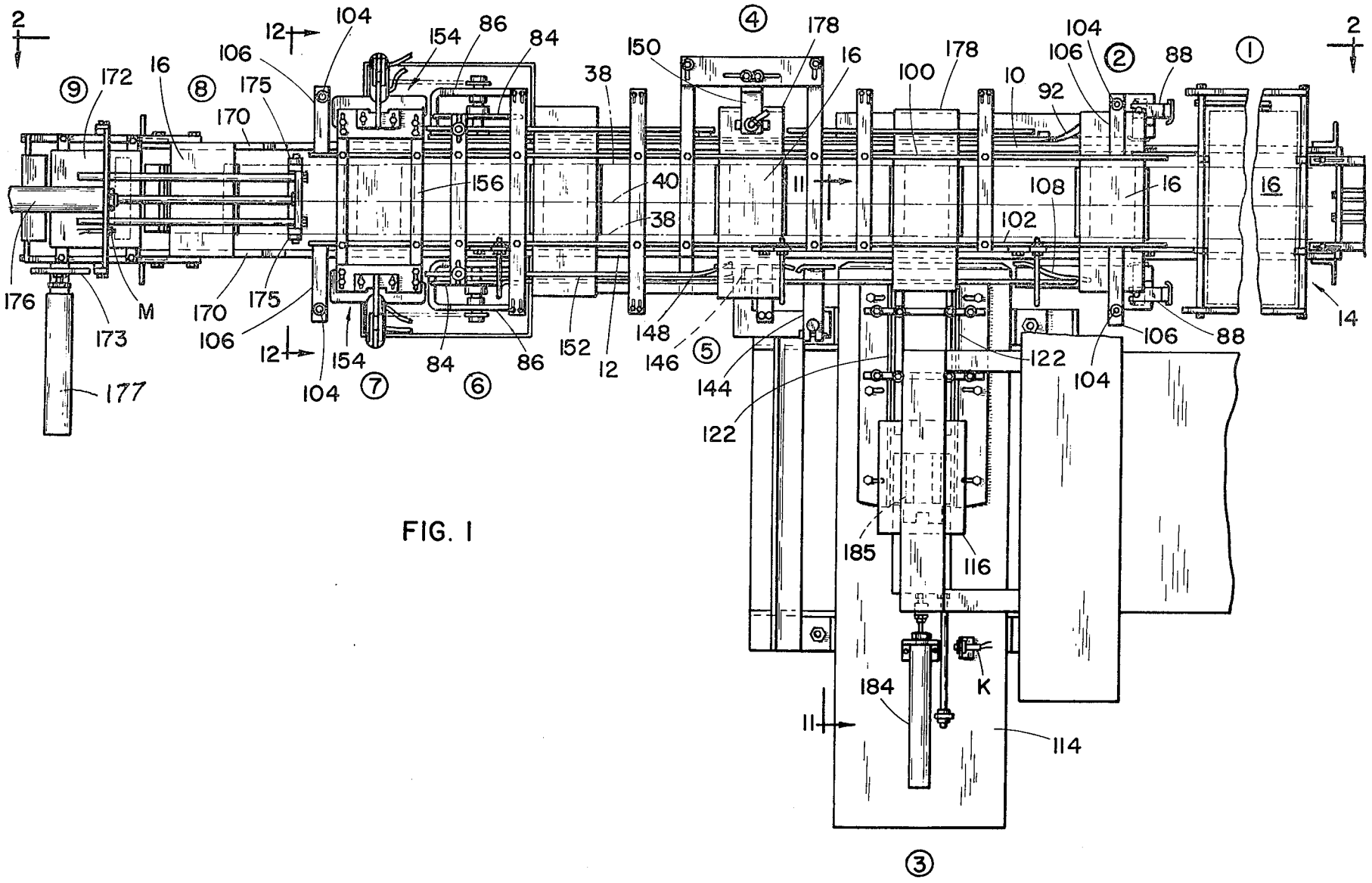
FIG. 1 is a plan view of the machine embodying the present invention, the right-hand end of the machine being broken to foreshorten the view.
Figure 4:
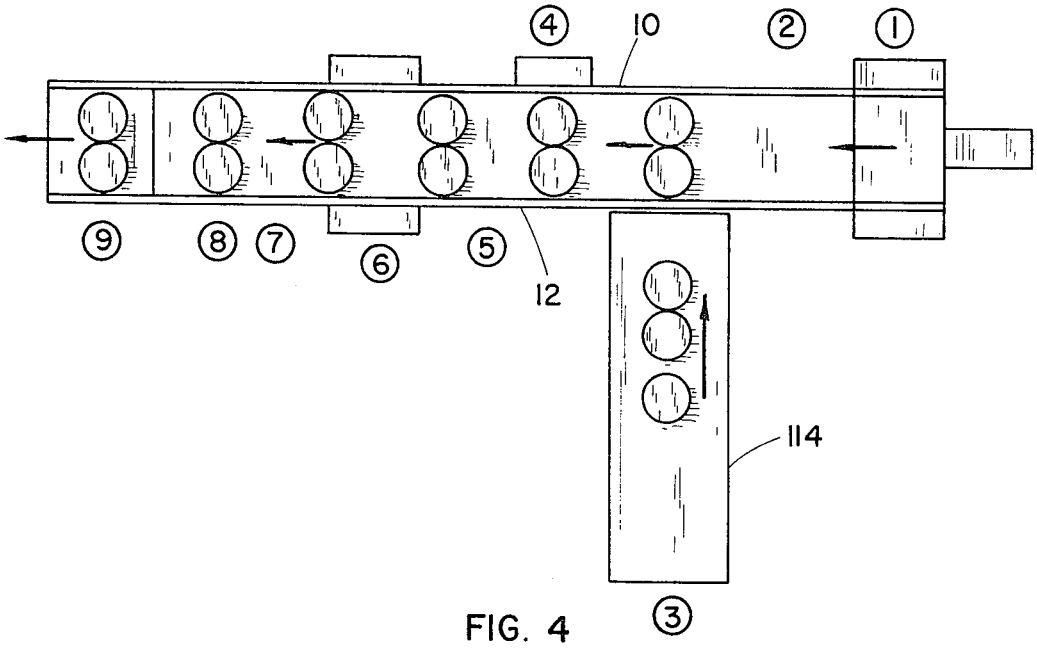
FIG. 4 is a diagrammatic plan view of the machine shown in FIG. 1 to facilitate an understanding of the successive operations performed upon cartons by the machine.

Referring to FIGS. 1 and 4, it will be seen that the machine comprises a frame consisting of a pair of main side plates 10 and 12 which extend for the full length of the machine. At the right-hand end of the machine as shown in these figures is a magazine 14, which is adjustable to hold a vertical stack of flattened cartons 16 which, for example, are of the die-cut type and are provided with foldable flaps extending from all four sides of the carton at both ends thereof. The machine is capable of successively pulling the lowermost carton from the stack in the magazine, setting the carton up by transforming it from flattened condition to one in which it is rectangular in cross-section. Said set-up occurs at station 1, as viewed in FIG. 4. The set-up cartons with the flaps extending outward from the opposite ends thereof are transferred, stepwise, to station 2, where the vertical end flaps at one end of the carton, which forms the so-called bottom thereof, are folded inwardly toward each other and the bottom flap at said end is also folded upwardly against the folded vertical flaps. The flaps are held in this condition by suitable guide plates and said cartons are then advanced to station 3, which is the transfer and loading station. Immediately before reaching station 3, the end of the carton nearest the loading station is open and at least certain of the flaps are folded backward to facilitate the receiving of contents into the carton.

After the carton has been loaded, it is transferred to station 4, where a date stamp is placed upon one of the upper flaps of the carton which still projects outwardly, followed by the folding of the vertical side flaps at the loaded end of the carton toward each other and also folding the bottom flap at said end of the carton upwardly, which occurs at station 5.

At station 6, the top flaps at opposite ends of the cartons still project outwardly and suitable adhesive of one of several kinds is applied to the lower surface of both of said flaps and, at station 7, these flaps are folded downwardly against the previously folded flaps and at station 8, the cartons are advanced between holding members which insure the final cementing of the outermost flaps at both ends of the carton in sealed condition.

The sealed cartons are then transferred to station 9 where they are weighed and the weight is automatically recorded, primarily to insure against short weight in any individual carton. If a short weight carton reaches the weighing station, it is automatically ejected but those cartons which have adequate weight are then transferred to suitable conveyors or otherwise for further packaging in larger cases or cartons, either for shipment or storage.

One of the very advantageous features of the present machine is that all operations are foolproof and the machine is completely automatic by employing solid state logic control means which insure that the transfer mechanism will not function until a carton is in position to receive the items to be loaded thereinto. Further, if the magazine is empty, the machine will continue to index but the transfer mechanism will not function. If a carton should fail to set-up properly, the machine will automatically advance until a properly set-up carton reaches the loading station. Also, if an oversized product is attempted to be loaded into a pack, mechanism is provided by which the machine feeding the loading and transfer mechanism stops and a suitable warning is sounded, either of an aural or visible nature, or both, and an attendant can suitably service the machine to prevent a jam from occurring.

Station 1 includes the magazine 14 which consists of a series of vertical and horizontal plates adjustably connected to each other to form a rectangle in plan view. The plates are suitably supported by the side plates 10 and 12 of the machine and they are adjustable to conform to a substantial range of different sizes of flat cartons. Angular retaining plates 18 hold the bottom of the stack of cartons 16 and, as viewed in FIGS. 7 and 8, a vertical cylinder 20 which is fluid-operated, preferably pneumatic, is supported between opposite sides of the machine below the sprockets 22 and 24, which are supported commonly upon a transverse shaft 26. The piston rod of cylinder 20 is connected to a crosshead 28, the opposite ends of which support vertical shafts 30 which extend upwardly and support inwardly extending plates 32 from which vertical members 34 extend upwardly to support suction cups 36 at the upper ends thereof. From FIG. 8 it will be seen that the pair of suction cups 36 respectively are disposed between the sprockets 22 and 24 which respectively support a pair of outer chains 38 and a center chain 40.

Figure 7:
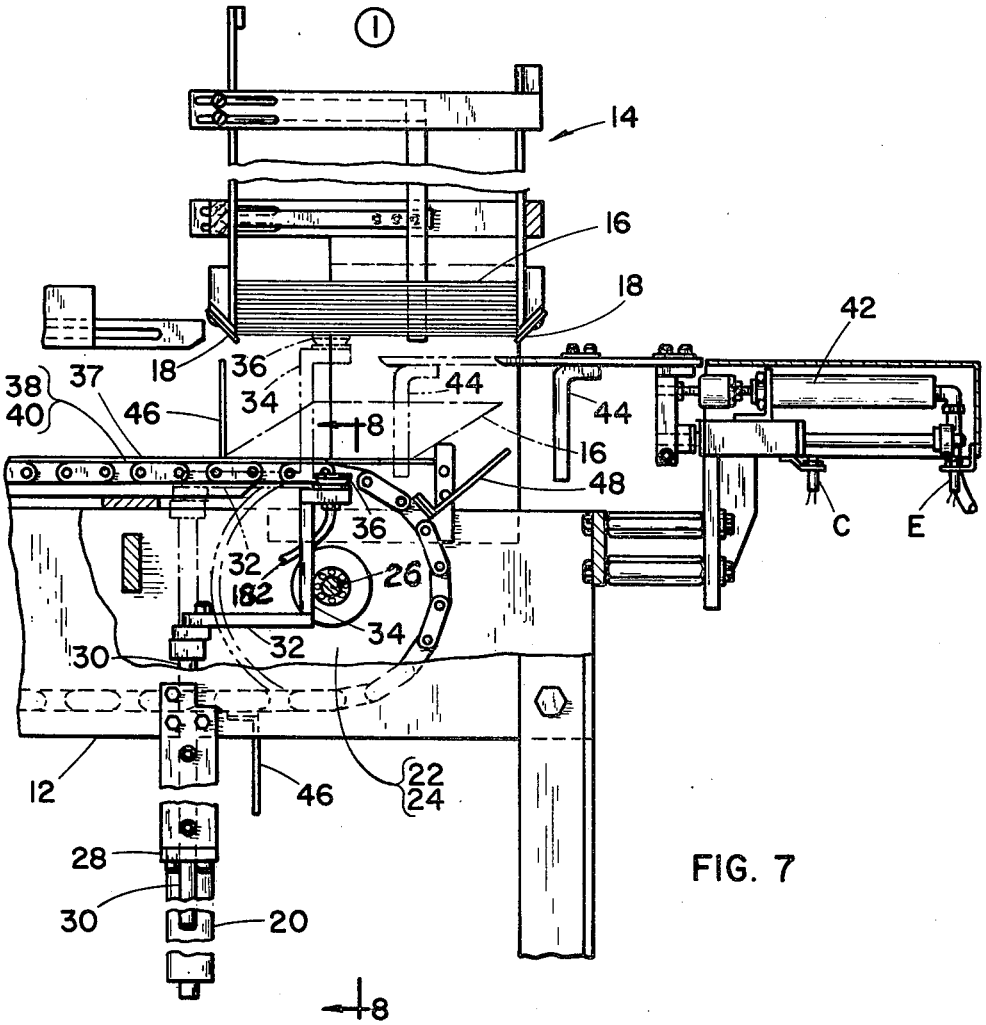
FIG. 7 is a fragmentary vertical elevation of the magazine and carton set-up mechanism of the machine shown adjacent the right-hand end of FIG. 1 as seen from the lower side thereof as viewed in said figure.
Figure 8:
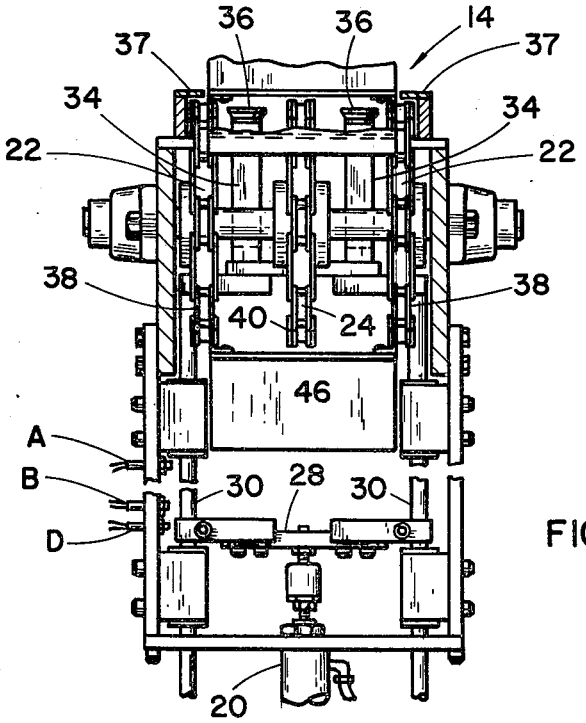
FIG. 8 is a fragmentary end view of the magazine end of the machine as seen in FIG. 7 on line 8—8 thereof.

In timed sequence, the cylinder 20 operates to project the suction cups 36 upwardly to engage the lowermost flattened carton 16 and subsequently pull the same past the retaining plates 18 and downwardly into contact with strips 37 of suitable plastic, such as Nylon, carried by plates 10 and 12 immediately above the chains 38 and 40, see FIG. 7. At this time, a horizontal cylinder 42, at the right-hand end of the machine as viewed in FIG. 7, advances horizontally extending set-up fingers 44 against the carton 16 shown against the chains 38 and 40 in FIG. 7 for purposes of transforming it from flat condition to rectangular condition.

The outermost chains 38 support alternate vertical compartment-forming plates or blades 48, while the central chain 40 supports similar alternate compartment-forming plates or blades 46. As seen in FIG. 7, the plate 46 is disposed vertically because of its position on the chain with respect to the sprockets 22, while the plate 40 is substantially at 2 o'clock, this being diverging from the plate 46. Accordingly, each successive pair of plates 46 and 48 comprise a compartment to receive one of the cartons 16, and it will be understood that additional plates 46 and 48 are disposed around the entire length of said chains but these are not shown in order to maintain the figure free from obstruction of the view. It will be understood that as the plate 48 of each of the compartments progresses to a position above the axis of the sprocket shaft, it, too, will become vertical with respect to the path for the cartons through the machine and will retain the set-up cartons in rectangular condition in cross-section as said cartons are moved by the conveyor to the various stations along the conveyor which are described in detail hereinafter. Dual set-up fingers 44 are spaced apart sufficiently to pass opposite edges of plate 48.

Figure 6:
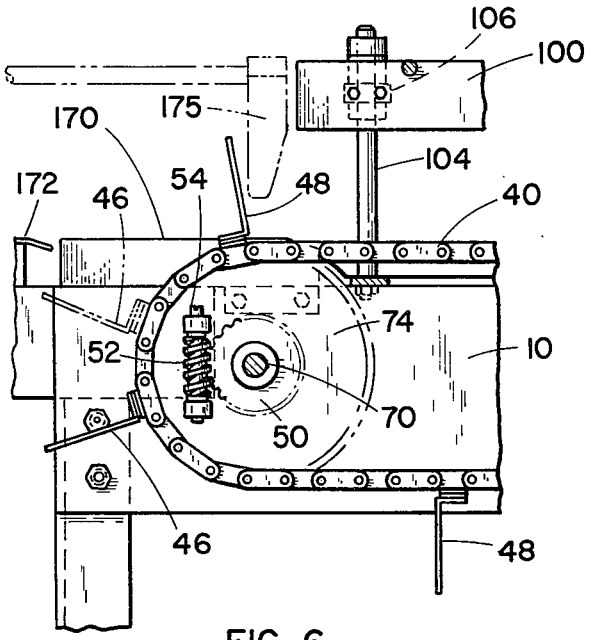
FIG. 6 is a fragmentary side elevation showing the mechanism for adjusting the chains of the conveyors with respect to each other to adjust the perpendicular members carried by the chain comprising compartment-forming means, said view being taken from the left-hand end of the machine shown in FIG. 1 along the side opposite the upper edge of said sheet as viewed in said figure.

Referring to FIG. 6, only the center chain 40 is illustrated therein with respect to its sprocket 74. As stated above, the shaft 70 commonly supports the sprockets 72 and 74. The sprockets 72 are fixed to the shaft 70, while the sprocket 74 is rotatably adjustable thereon through as much as 270° by means of a worm gear 50 which is fixed to the shaft, and a worm 52 which is rotatable within bearings secured to one face of the sprocket 74. A slot 54, such as a screw driver slot, is formed in one end of the worm to effect the desired adjustment of the sprocket 74 with respect to the outer sprockets 72 and thereby effect a different spacing between the compartment-forming plates 46 and 48 to accommodate a substantial range of sizes of cartons therebetween. It also will be understood that there is a space between each compartment, especially to enable suitable spacing of the various flap-folding elements described hereinafter.

STEPWISE DRIVE MECHANISM

Figure 5:
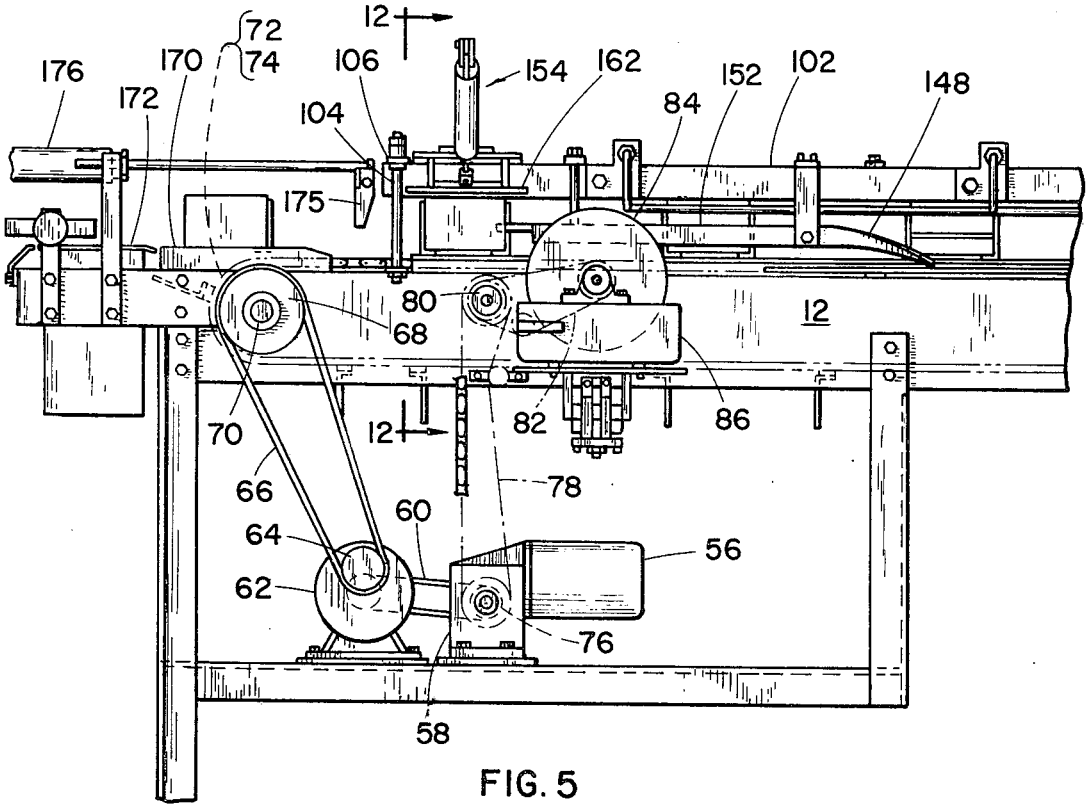
FIG. 5 is a fragmentary side elevation of the machine shown in the preceding figures and illustrating in general the drive mechanism for the machine.

Referring to FIG. 5, it will be seen that power to drive the machine is furnished by an electric motor 56, which is connected to a gear reduction unit 58, which, in turn, by means of an endless drive member 60, belt or chain, operates an intermittent drive unit 62 which is of the type that makes, for example, one complete revolution of the output pulley 64 and then stops until next energized by the control means of the machine described hereinafter. Output pulley 64 by means of drive belt 66 drives the driven pulley 68 which is fixed to shaft 70 which supports and drives outer sprockets 72 and center sprocket 74 around which the outer chain 38 and center chain 40 respectively extend.

Gear reduction unit 58 also has an output pulley 76 thereon which drives a belt 78 that extends around safety clutch 80 which drives belt 82 for purposes of rotating disc 84, comprising a distributing member for adhesive contained in reservoir 86, the purpose of which is described hereinafter.

FLAP-FOLDING UNITS

Figure 9:
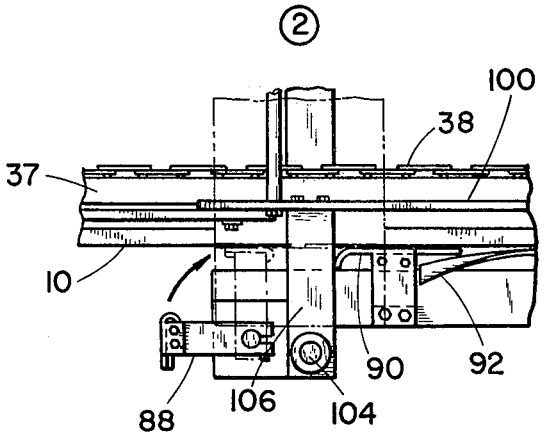
FIG. 9 is a fragmentary plan view of the side of the machine shown nearest the top of the sheet with respect to FIG. 1 and comprising flap-folding mechanism operable upon the side flaps of the end of the carton which will form the closed bottom thereof prior to loading the carton, said view being taken on the line 9—9 of FIG. 10.
Figure 10:
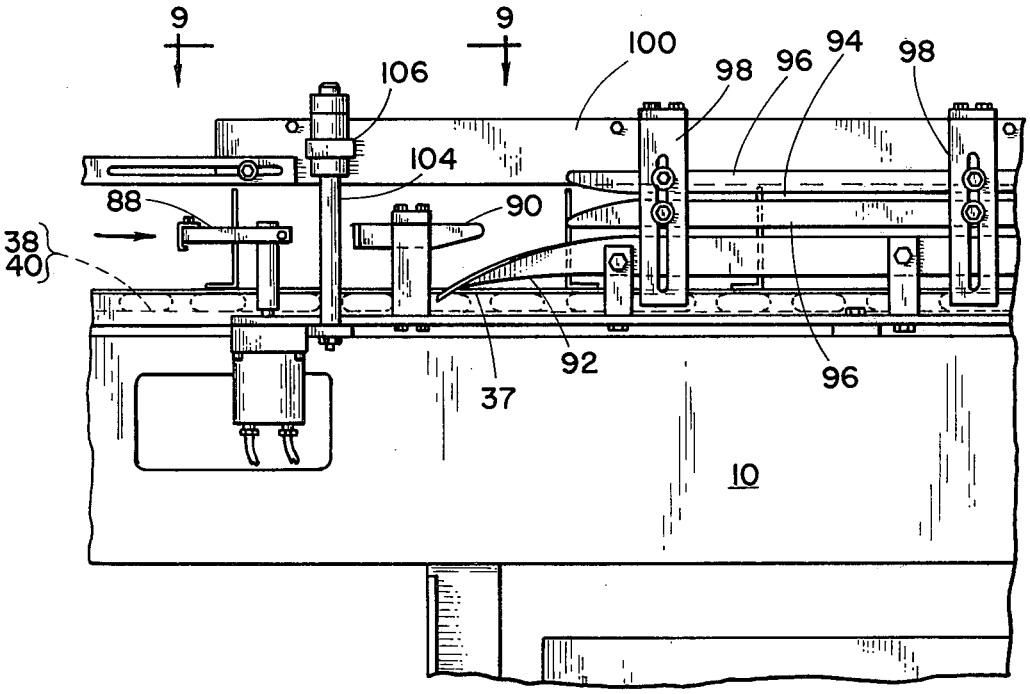
FIG. 10 is a fragmentary vertical elevation showing the flap-folding structure shown in FIG. 9, as well as additional flap-supporting and positioning mechanism relative to the flaps forming the bottom of the carton.

Referring to FIGS. 1, 9 and 10, after the cartons have been set-up and have passed from beneath the magazine 14, each end will have a pair of vertical flaps projecting therefrom and also a pair of respectively top and bottom flaps. The flaps projecting from the ends of the carton nearest side plate 10 will form what will be termed the bottom of the carton since this end is closed first in order to condition the carton to receive products to be received from the loading or transfer mechanism at station 3. A rotatable arm 88 is rotated in the direction of the arrow shown in FIG. 9 to engage and fold the trailing vertical flap into closed position, while a fixed cam 90 engages the leading vertical flap and folds it into closed condition. Referring to FIG. 10, a further stationary cam 92 engages the bottom flap and folds it upwardly but the top flap remains in projecting horizontal condition and is received within a slot 94 between guide plates 96 which are vertically adjustable relative to vertical supporting members 98. In addition to the longitudinal main frame members 10 and 12 of the machine, there also are a similar pair of vertical adjustable upper frame members 100 and 102, best shown in FIG. 1. These frame members support the vertical supporting members 98, for example, and opposite ends of the upper frame members 100 and 102 are respectively supported by vertical posts 104, which are fixed at the lower ends thereof to the main frame plates 10 and 12. As seen in FIG. 1, horizontal brackets 106 extend outwardly from the upper frame plates 102 for adjustable connection to the vertical posts 104 by suitable conventional means.

TRANSFER AND LOADING UNIT

Figure 11:
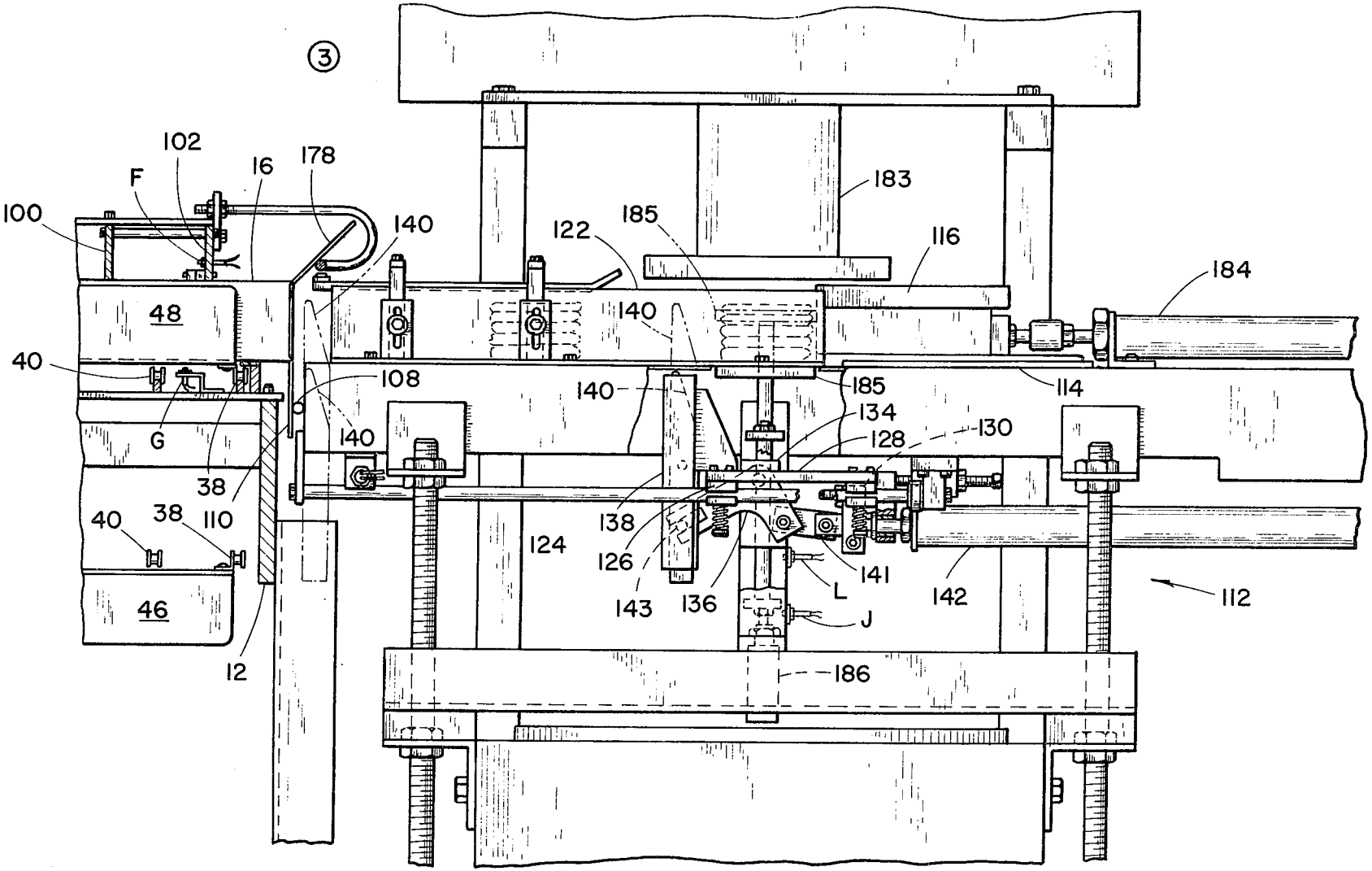
FIG. 11 is a fragmentary transverse sectional view of the transfer mechanism located at the loading station for purposes of projecting products into the open end of a carton shown fragmentarily at the left-hand end of said figure.

At station 3, as the cartons arrive sequentially adjacent the upper end thereof as viewed in FIGS. 1 and 4, there is associated therewith a stationary cam 108 which engages the bottom flap on the open end of each carton and operates to cam the flap downwardly as shown in FIG. 11, said flap being indicated by reference character 110. It will be understood that the transfer and loading unit 112 has a horizontal plate 114, shown in FIGS. 1 and 11, which is on the same plane as the bottom wall of a carton 48, as shown in FIG. 11, so that as articles to be transferred to said carton may be moved thereinto through the open end of the carton by vertical fingers 140 which are actuated by a fluid-operated cylinder 142, preferably pneumatic.

For purposes of each of illustration and description, assume that a predetermined number of hamburg patties, such as a pair of stacks of four or six patties, is to be loaded into a carton. Said patties are received from a unit 120 which, while associated with the present invention, comprises no part thereof except to supply such patties. The transfer and loading unit 112, in addition to having the horizontal supporting plate 114, also is provided with a pair of vertical side plates 122 which are adjustable toward and from each other to accommodate a range of different sizes of articles to be loaded into the cartons. Referring to FIG. 11, there is a pair of horizontal guide rods 124 supported stationarily adjacent the main frame plate 12. Yieldable friction blocks 126 slide upon said guide rods and are connected to a plate 128 which carries additional guide blocks 130 engageable with rods 124. Connected to plate 128 is a pivot block 134 which pivotally supports a bell crank 136.

Also, supported by plate 128 is a pair of vertical guide members 138 within which vertically slidable push fingers 140 are mounted. In FIG. 11, the fingers are shown in phantom in projected position. Said fingers have a pin 143 thereon which extends within a slot in one end of bell crank 136. The opposite leg of bell crank 136 is connected to a link 141 which is pivotally connected to one end of the piston rod of a fluid-operated cylinder 142, which is preferably pneumatic.

When a charge of a suitable quantity or predetermined number of objects have been placed upon the horizontal plate 114 which extends to the discharge end of the transfer and loading unit 112, the cylinder 142 is activated and the initial movement of the piston rod rotates bell crank 136 clockwise, as viewed in FIG. 11, against a suitable stop on plate 128, and thereby causes the elevation of the pushing fingers 140, and thereafter, continued movement of the piston rod pushes plate 128 with the friction blocks 126 and 130 to the left, as viewed in FIG. 11, thereby moving the pushing fingers 140, shown in phantom position horizontally to insert the product into the carton.

Upon retracting movement of the piston rod of cylinder 142, the initial movement thereof serves to rotate the bell crank 136 counterclockwise, moving the push fingers 140 downwardly so as to be below the level of plate 114 upon which a subsequent batch of articles may be accumulating for loading into the next succeeding carton. After the fingers 140 have been retracted, continued retraction of the piston rod of cylinder 142 will restore the guide members 138 to the initial position thereof in which they are adapted to engage the next batch of articles to be loaded into the carton.

TOP FLAP CLOSING MECHANISM

Referring to FIG. 1, after the cartons have received the desired products to be enclosed therein, at station 5, the end of the carton which has just been filled has the trailing vertical flap folded into closed position by rotatable arm 144 which is very similar to the rotatable arm 88. The leading vertical flap is engaged by stationary cam 146 which folds it into closed position. Immediately thereafter, cam 148 engages the bottom flap and folds it upwardly into engagement with the previously folded vertical flaps. These folded flaps are then maintained substantially in closed position by engaging the inner surface of an elongated vertical plate 152 until the carton reaches station 6 where adhesive is applied to the under surfaces of the projecting top flaps at opposite ends of the carton. The adhesive-applying unit is also illustrated in FIG. 5 and comprises a rotatable disc 84 which rotates within a reservoir 86 continuously. This particular adhesive-applying means is illustrated as being the type which operates with a so-called hot-melt adhesive that is picked up by disc 84 and is applied by the rim thereof to the under surface of the top flap at each end of the carton. A pair of these adhesive-applying units respectively are mounted adjacent opposite sides of a conveyor respectively to apply adhesive to the top flaps at opposite ends of the carton. Especially if the adhesive-applying unit applies hot-melt adhesive, it will be seen that the same is immediately upstream from the top flap closing station 7, details of which are described below.

However, the adhesive employed may be of other types than hot-melt but preferably of a relatively quick-drying type of adhesive which is applied by the disc 84 in each of the applying units.

Figure 12:
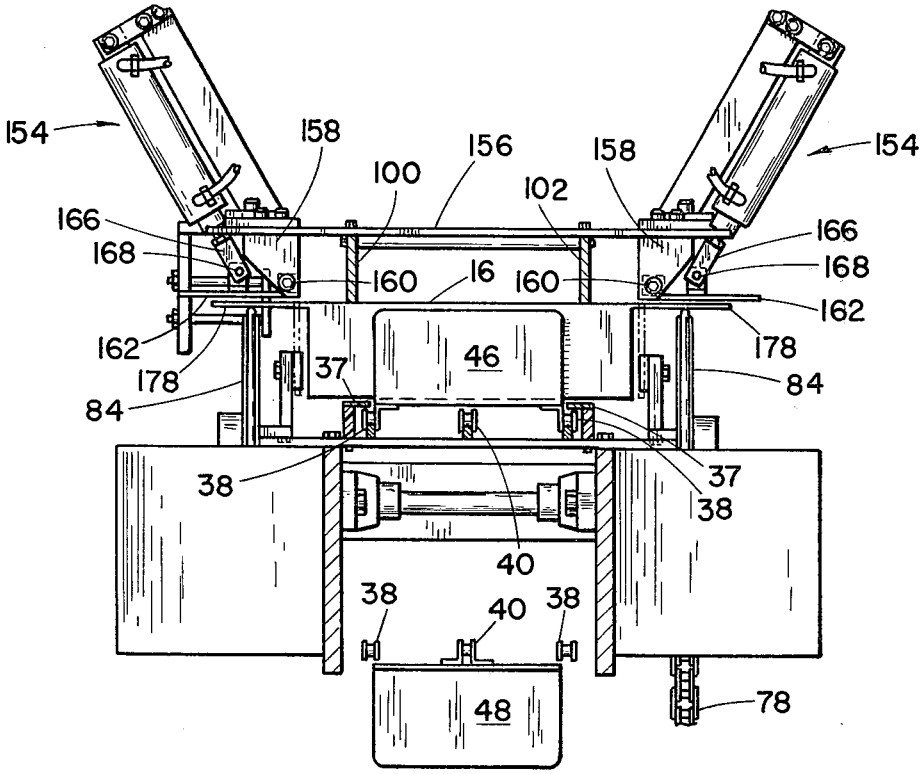
FIG. 12 is a fragmentary transverse sectional view of the top flap closing unit as viewed on the line 12—12 of FIGS. 1 and 5 and illustrated on a substantial larger scale to show details thereof.

As soon as the adhesive has been applied to the lower surfaces of the projecting top flaps at opposite ends of the carton, they are engaged by closing units 154, which are illustrated in enlarged detail in FIG. 12. Only one of said units is shown but it is to be understood as shown in FIG. 1, that there is a similar unit at either side of the conveyor. These units are supported by a pair of cross bars 156, which are supported by the upper edges of upper frame members 100 and 102. A yoke 158 is connected to the projecting ends of the cross bars 156 and a shaft 160 extends between the lower ends of the legs of yoke 158 for purposes of supporting a pivoted plate 162, which is actuated by a fluid-operated cylinder 164, preferably pneumatic, and having a piston rod which mounts a clevis 166 on the lower end thereof to receive a pin 168 which is connected to a projection on plate 162. As soon as the cartons reach station 7, the cylinders 164 are actuated to instantly pivot the plates 162 downwardly substantially into vertical position against the top flaps at opposite ends of the carton and securely presses said ends which have the adhesive on the inner surfaces thereof against the previously folded vertical and bottom flaps, thus completing the sealing of the cartons which are carried toward the exit end of the conveyor, past adhesive-curing station 8, which comprises elongated, horizontal sealing bars 170, which are shown fragmentarily at the left-hand end of FIG. 1. These bars are of sufficient length to insure adequate curing of the adhesive so that the sealed flaps will remain in closed position.

Figure 3:
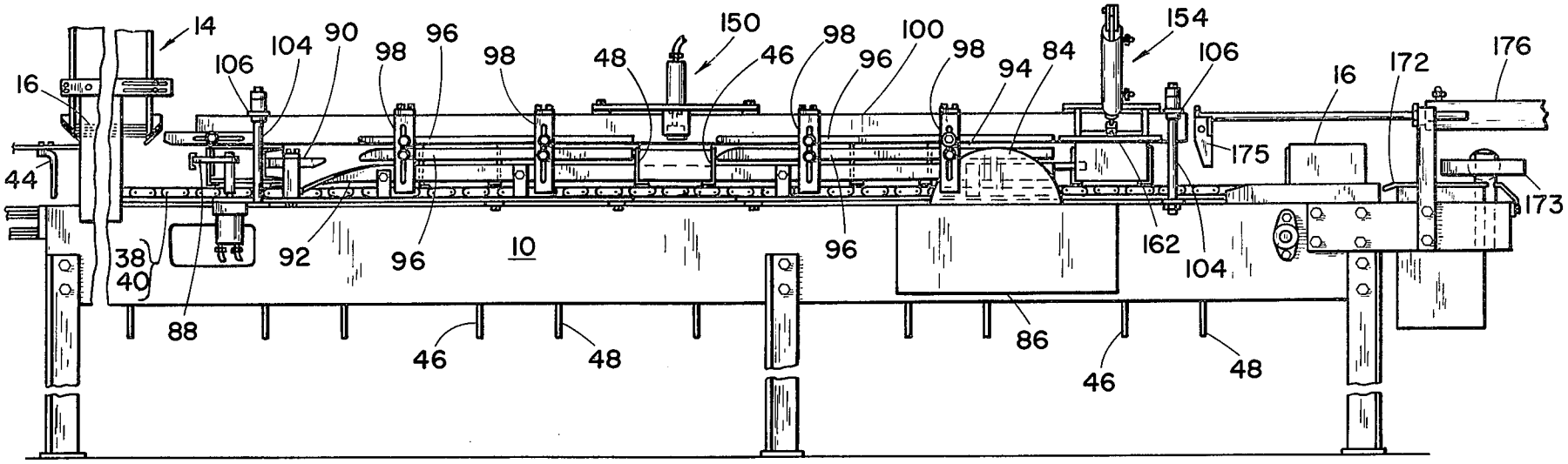
FIG. 3 is a side elevation of the machine shown in FIG. 1 as seen on the line 2—2 of FIG. 1.
Figure 2:
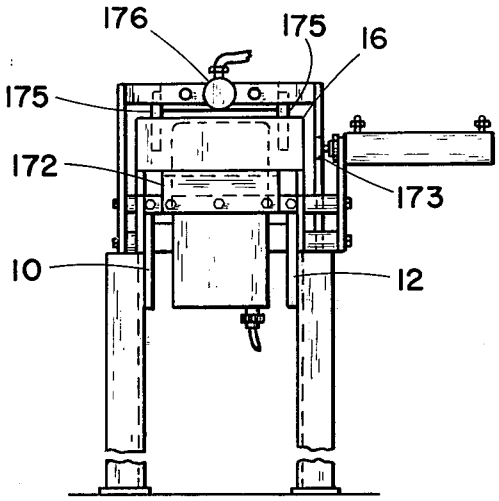
FIG. 2 is an elevation of the discharge end of the machine shown in FIG. 1.
Figure 13:
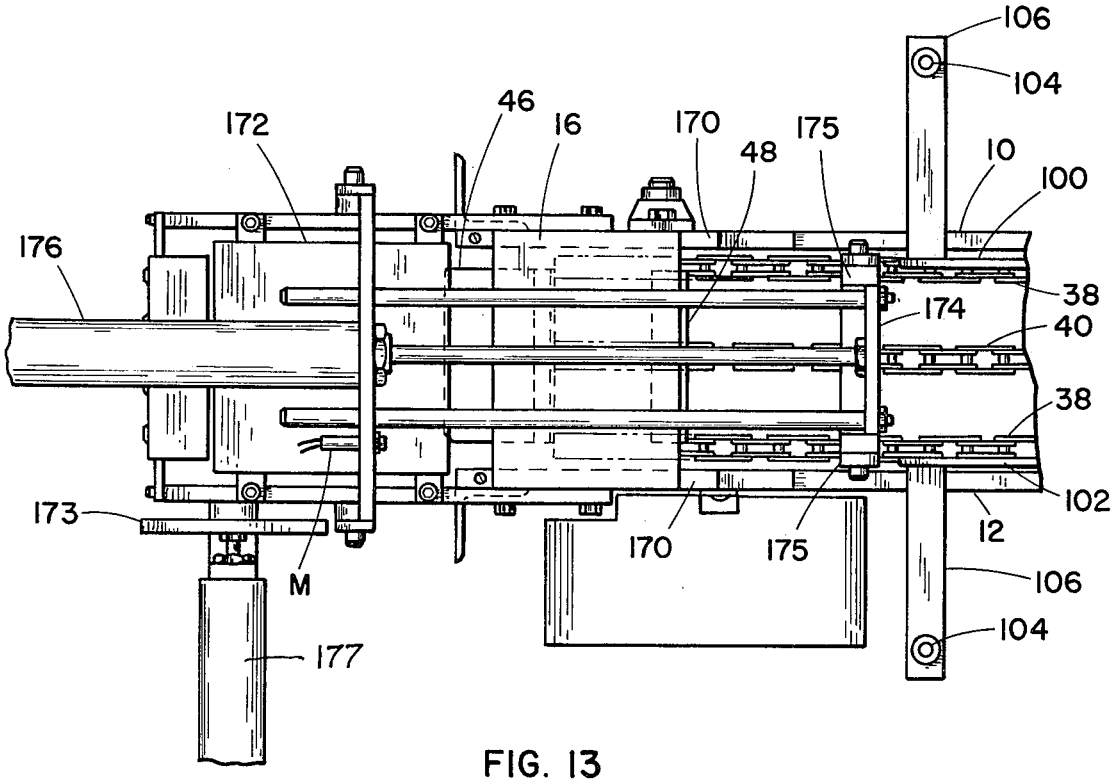
FIG. 13 is a fragmentary plan view of the discharge mechanism at the loading station and illustrating the structure shown in side elevation in FIG. 11.
Figure 14:
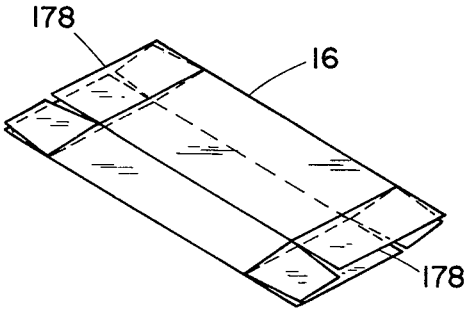

After the sealed cartons exit from the adhesive-curing station 8, they are moved to station 9, which comprises a receiving plate 172 of a weighing unit. The positioning of the carton upon the plate 172 occurs immediately after the filled cartons reach the exit end of the conveyor chains, as can readily be visualized from FIG. 3. The weight of each carton is recorded on a recording unit, not shown, which preferably includes a visual indication of the weight, and if the weight is not adequate, a rejecting push plate 173, as shown in FIG. 13, is operated by a fluid-operated cylinder 177 supported by part of the frame structure of the machine and actuated by suitable control means, described hereinafter, for purposes of ejecting an underweight carton from the receiving plate 172.

The sealed cartons are successively moved from the exit end of the conveyor onto the plate 172 by crosshead 174 which has pivoted, depending fingers 175 adjacent opposite ends thereof and operable when pushed toward the conveyor by cylinder 176 to engage the trailing end of a carton and pull the same onto the weighing scale 172. An acceptable carton is pushed from the scale by the next oncoming carton onto a suitable removing conveyor.

FLAP-FOLDING SEQUENCE

Figure 17:
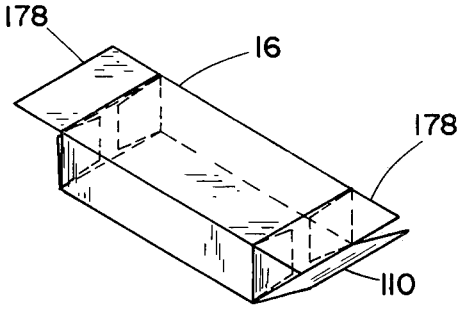
Figure 18:
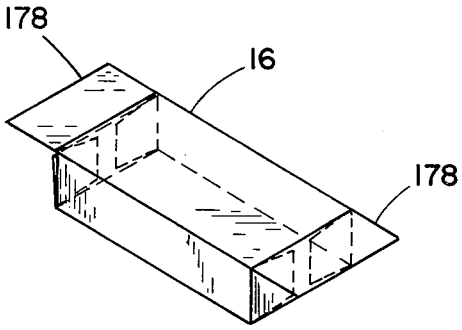
Figure 19:
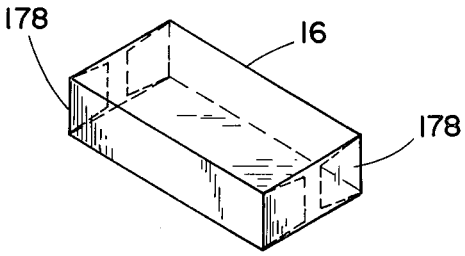

Attention is now directed to FIGS. 14–19 which are of a diagrammatic nature and respectively illustrate the successive steps performed by the machine described above for purposes of transforming a flattened carton 16, shown in FIG. 4, into a completed carton 16, as shown in FIG. 19, in which all of the end flaps have been folded and sealed into closed condition.

Figure 15:
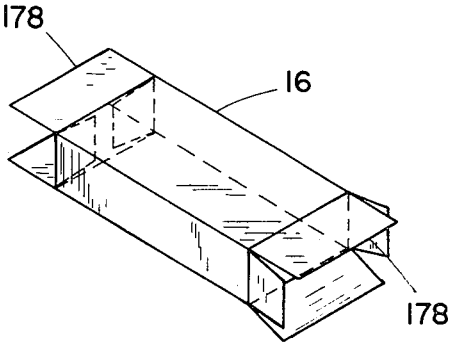
Figure 16:
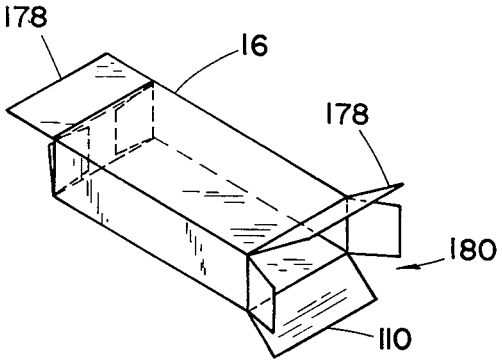

As described in greater detail above, the flattened carton 16 is pulled from the bottom of the stack in magazine 14 and is pulled by vacuum cups into set-up station 1, where it is transformed into a rectangular configuration in cross-section, as shown in FIG. 15. Immediately upon this occurring, the vertical end flaps at the bottom end 178 are folded inwardly toward each other and immediately thereafter, the bottom flap at said bottom end 178 is folded upwardly, as shown in FIG. 16, while the top flap at the bottom end remains in its initial projecting position, as shown in said figure. In this figure, there also is illustrated the position of the flaps at the open, loading end 180 of the cartons, where it will be seen that all of the flaps preferably are extended in somewhat diverging relationship to insure the ready movement of articles or items to be loaded into the carton.

Referring to FIG. 17, it will be seen that at stations 4 and 5, the date is applied to one of the top flaps, such as at the bottom end 178 of the carton, while the vertical side flaps and bottom flap at the filling end 180 of the carton are folded inwardly and upwardly respectively but the top flap remains in projected condition. In FIG. 18, station 5 has completed the folding of the vertical side flaps and bottom flaps at the loading end of the carton and in this condition, the carton passes to station 6 where the adhesive is applied to the under surfaces of the projecting top flaps, following which the carton is moved to station 7, where the top flaps are both folded into closed position for sealing engagement with the previously folded vertical side flaps and bottom flaps.

As indicated above, one of the very desirable advantages of the present invention comprises the fact that appropriate safety means and controls are arranged in the operating system of the machine to prevent malfunctions and to insure that the machine will operate in desired sequence and that, in general, certain successive operations will not occur until the required preceding operation has taken place. To illustrate the control means of the system, attention is directed particularly to FIGS. 1, 7 and 8 wherein sensor A is positioned to take effect when cylinder 20 has fully extended the suction cups 36 into engagement with the lowermost flat carton in the magazine 14. When this occurs, the pneumatic control, not shown, for the cylinder 20 is actuated to retract the piston rod of the cylinder and effect vertical downward movement of crosshead 28 and the elements attached thereto for purposes of pulling the lowermost carton into the set-up station 1. When the cylinder 20 has retracted horizontally, level with chains 38 and 40, sensor B is closed to activate cylinder 42 which extends the vertical set-up fingers 44 against the carton 16 as shown in FIG. 7. The vacuum cups 36 preferably are connected to a source of vacuum by conduit 182, shown in FIG. 7, and when cylinder 42 has been fully extended to set-up a carton, sensor C is closed to effect release of the vacuum and retracts the vacuum cylinder to the lower position thereof shown in FIG. 7, which is approximately ½ inch below the operating level for the carton 16. When this occurs, sensor D is closed to effect a stepwise movement of the conveyor if all other sensors downstream have been satisfied that the operation is normal. Upon completion of an index movement, cylinder 42 is retracted, closing sensor E, permitting cylinder 20 to operate to pull down the next carton.

If a carton 16 which has been set-up at station 1 is moved in satisfactory condition to station 3 to be loaded with items or articles, such as exemplary hamburg patties referred to above, sensors F and G are located so as to be activated to prove the presence of a carton at stations 3 and that the same is properly set-up. If, however, no carton is in filling station 3 or one is present that is improperly set-up, said sensors will remain open and the unit will continue to index and pull down and set-up a carton until one is properly present at station 3, when sensors F and G will be closed. When sensors F and G are closed, the unit will not index again until carton loading fingers 140, shown in FIG. 11, are activated by cylinder 142 and such action will close sensor H, which will indicate that the carton has been properly loaded with articles or items as desired. Activation of sensor H causes the unit to index one unit again and progressively moves all cartons to the next station, including the set-up of another carton in station 1.

Assuming as above, that hamburg patties are to be loaded into the cartons, it is to be understood that said patties are counted, interleaved with separating paper, and stacked onto packing friction devices according to pre-set counts on the stacker-counter, not illustrated. Vertical overhead cylinder 183 reciprocates to push each patty down against platform 185 which is movable relative to an opening in plate 114, which is pushed downward by each patty until a stack count is satisfied, at which time vertical lower cylinder 186, shown in FIG. 11, which supports platform 185 by friction means retracts the same, with a stack of patties thereon, downward and flush with the horizontal operating plate 114. This will simultaneously close sensor J, shown in FIG. 11, which activates horizontal cylinder 184 and causes the same to extend and unload a stack from platform 185. After unloading one or two stacks onto plate 114, according to programming control, fingers 140 are extended above the level of horizontal plate 114, and simultaneously loads both stacks of product into a carton. When unloader cylinder 184 is extended, it closes sensor K shown in the lower portion of FIG. 1, which extends the piston of vertical cylinder 186 upwardly to receive the next stack of patties.

The loading and transfer mechanism at station 3 will commence to form a stack of patties when sensor K is closed. When platform 185 is fully up, sensor L in FIG. 11 activates cylinder 184 which retracts pusher member 116 from the initial stack of patties from the platform 185. Speeds as fast as one stack per second are possible with four patties in a stack. When the second stack is unloaded, it moves the first stack to the position shown in FIG. 11 and every second pair of stacks initiates cylinder 142 to automatically extend the push fingers 140 up through the horizontal plate 114. When cylinder 142 is activated, it closes sensor H and indexes all stations one index position and then activates cylinder 142 which also effects retraction of the push fingers 140 during such movement of the piston within cylinder 142. This permits the transfer and loading unit 112 to unload the first stack for the next carton during the retraction of cylinder 142 and, thus, speeding up the operation of the unit.

By means of the programmed logic, every time sensor H is activated, conveyor and all units of the system must index and advance a filled carton away from the transfer and loading unit 112 so that the next empty carton will be disposed in proper position in station 3. Condition is proven by means of the programmed logic. For every operation of sensor H, sensors F and G must be open and again are closed by the next empty carton before cylinder 142 can insert the next exemplary pair of stacks of hamburg patties. The logic system also is proved every time the desired number of stacks are unloaded from platform 185. Sensor H must be closed before cylinder 184 can unload the next stack onto the platform 114 and unless such next stack can be unloaded, cylinder 184 cannot extend to close sensor K and the operation of patty stacking mechanism is stopped until the aforementioned conditions are met. When they are met, all elements of the system will continue to function in sequence automatically.

After each indexing of the machine, cylinder 176 at station 9, retracts to permit a filled and sealed carton to be disposed upon the receiving plate 172 of the weighing unit. This closes sensor M which extends cylinder 176 for the next carton and also activates the weighing cell associated with the plate 172. If the proper weight is not present in any individual carton, a cylinder 177 in FIGS. 1 and 13 actuates a rejector pusher bar 173, shown in FIG. 13, which pushes the underweight carton from the plate 172.

The cylinder 150 of the date stamping unit is activated by being extended and retracted after each index movement of a carton has occurred. Also, the rotatable arms 88 and 144 are extended after each indexing movement of the conveyor to tuck the vertical trailing edge flap inward and said rotatable arms are retracted after tucking each one of their foldable flaps inward in order to be properly positioned at the next index movement of the conveyor.

In accordance with the programmed logic of the system, all elements thereof are safely interlocked and are jam proof, preventing the loading operation of unit three when no carton is present or when attempting to load an already loaded carton or one which is improperly set up. It also will be understood that operation of the entire unit is initiated by a starting switch, not shown, such as one which controls the operation of motor 56, among other functions.

The rotatable arms 88 and 144 are all activated by units identified by the trademark "ROTAC." These units are pneumatically operated cylinders which effect rotation of a shaft through a predetermined arc such as 90°, 180°, or as much as 270°. In the present structure, the rotatable arms are affixed to the shaft of such units which, because of their nature, are relatively compact. Further, in the overall operation of the machine, pneumatic means are preferred, unless otherwise excepted specifically, in regard to the various fluid-operated cylinders employed throughout the machine.

It also is conceivable and possible that the machine can be mounted in position to load loose or granular material into the open ends of the cartons, such as by rotating the entire machine 90° about the longitudinal axis thereof in a direction to dispose the open ends of the cartons uppermost to receive such material by gravity. Under such circumstances, the specific loading mechanism disclosed herein at station 3 will have to be replaced by a suitable feeding and measuring unit, possibly of conventional type, to handle such material for discharge into said cartons.

The foregoing description illustrates preferred embodiments of the invention. However, the concepts employed may, based upon such description, be employed in other embodiments without departing from the scope of the invention. Accordingly, the following claims are intended to protect the invention broadly, as well as in the specific forms shown herein.

I claim:

1. A carton set-up and loading machine comprising in combination:

a. a magazine to hold a supply stack of flattened die-cut cartons having flaps projecting from all edges of the opposite ends thereof, b. endless conveyor means having a loading end positioned substantially opposite said magazine successively to receive individual cartons therefrom and the opposite end comprising a discharge end, c. suction means adjacent said loading end of said conveyor means beneath said magazine and mounted for vertical movement into engagement with the lowermost carton in said magazine and operable to pull the same from said magazine and deposit it onto said conveyor means in transverse position thereon, d. means to set up said cartons on said conveyor in expanded condition, comprising perpendicular members on said endless conveyor means spaced therealong and pusher means supported adjacent said magazine and operable sequentially relative to alternate perpendicular members to set up each carton from flat condition prior to said cartons being engaged by the next successive perpendicular member, e. article-loading means extending transversely to said conveyor and having one end adjacent one edge of said conveyor intermediately between said ends thereof, and including f. guide means adjacent one edge of said conveyor means, pusher means movable reciprocably along said guide means to push articles along said guide means toward said conveyor means, and controlled power means to operate said pusher in timed sequence, g. means along said conveyor means between said magazine and said article-loading means operable to fold closed the side flaps and lower end flap on the end of a deposited carton adjacent the opposite edge of said conveyor means from said article-loading means, thereby to arrange said carton to receive articles moved into the opposite open loading end of said carton by said article-loading means, h. means operable to fold closed the side and bottom flaps of the loading end of said carton after the same has had articles inserted therein while the upper flaps at the bottom and loading ends of the carton remain projected outwardly, i. means to apply adhesive simultaneously to the lower surfaces of said projecting upper flaps, j. means operable to fold said upper flaps shut to permit said adhesive to adhere to the previously folded flaps, and k. means operable to advance said conveyor stepwise between the operations of said aforementioned means.

2. The machine according to claim 1 in which the cartons when expanded upon the conveyor have two vertical side flaps at each end and horizontal top and bottom flaps at each end, whereby as said cartons are moved in feeding direction by said conveyor said cartons have leading and trailing vertical side flaps, and said means to fold said flaps to closed positions comprise respectively stationary cams to fold the leading vertical side flaps toward the other, rotatable power-driven means to fold said trailing vertical side flaps toward the other, stationary cam means to fold the bottom horizontal flaps upwardly, and pivoted members immediately above and parallel to said top flaps and operated by fluid actuated power means to swing downwardly and fold said top horizontal flaps rapidly downward over the previously upwardly folded bottom flaps to which said top flaps are adhesively attached.

3. The machine according to claim 1 in which said perpendicular members on said conveyor means comprise compartment-forming means consisting of transverse blade members positioned on said conveyor means to define the forward and rearward confines of each compartment and adjustably spaced apart longitudinally on said conveyor means to closely contain cartons and engage opposite vertical sides thereof to maintain the same set-up with the sides of the cartons vertical and the top and bottom panels flat and horizontal while being loaded and while said flaps are being folded closed.

4. The machine according to claim 3 in which said conveyor means comprises a plurality of endless chains extending around sets of sprockets supported upon shafts respectively adjacent said loading and discharge ends of said machine, said chains spaced transversely and parallel to each other, alternate perpendicular blade members being attached to one of said chains and the intermediate perpendicular members being attached to another of said chains, one of said sets of sprockets being idlers and power means being connected to the other set of sprockets, and said machine further including rapidly operated adjustment means comprising a worm gear fixed to one of said shafts and a worm engageable therewith and rotatably supported by the center sprocket, said worm being rotatable to change the center sprocket rotatably to vary the longitudinal distance between successive perpendicular blade members to vary the length of said comparments in feeding direction and thereby permit the machine to accommodate cartons of a range of different sizes.

5. The machine according to claim 3 in which said conveyor means comprises endless chains supported by sprockets respectively adjacent said loading and discharge ends of said machine, one of said sprockets being substantially in perpendicular alignment with said carton magazine and as said compartment-forming blade members are carried by said chains around said sprockets they are radial to the axis of the sprockets but are perpendicular to the longitudinal paths of the spans of said chains between said sprockets, whereby when a flattened carton is moved into one of said compartments beneath said magazine the leading compartment-forming blade member is vertical but the trailing blade member slants outwardly at the outer edge to form a compartment momentarily having outwardly diverging sides but as said trailing blade member moves forwardly, it becomes vertical and thereby compresses the opposite side edges of the carton and compresses the same to expand the carton from flat condition to set-up rectangular condition in cross-section.

6. The machine according to claim 1 further including a logic control system comprising a pair of sensors adjacent said article-loading means above and below the carton and respectively operable to sense the presence of the top and bottom panels of the set up cartons as they arrive successively at said article-loading means, said system being connected to said controlled power means for said article-loading means and operable to prevent operation of said loading means unless a set up carton is in correct position to receive articles from said loading means.

7. The machine according to claim 1 further including automatic weighing means adjacent said discharge end of said conveyor means operable to register the weight of each loaded carton moved onto said weighing means from said conveyor and including a plate to receive each carton successively and an electronic weighing cell responsive to movement of said plate, a discharge conveyor positioned to receive loaded cartons from said weighing means, electronic control means responsive to the weight of said cartons, an electronic sensor positioned adjacent said plate and engageable by said carton when positioned upon said plate to energize said electronic weighing cell, and ejecting means operable by said control means to deflect underweight cartons from said weighing means and thereby prevent transfer of any said underweight carton to said discharge conveyor.

8. The machine according to claim 7 in which said ejecting means comprises a pusher member operated directly upon the end of a piston rod of a fluid-operated cylinder.

9. A carton set-up and loading machine comprising in combination:

a. a vertical magazine to hold a stack of flattened die cut cartons having flaps on all edges of both ends thereof and having a carton discharge at the lower end thereof, b. a conveyor having compartment-forming members on endless chains extending around sprockets respectively adjacent opposite ends of said conveyor, one end comprising the loading end which is beneath the magazine and the other, the discharge end, c. means on said conveyor operable to set up said cartons from flat to rectangular condition in cross-section, d. power means connected to the sprockets at one end of the conveyor arranged to move the conveyor stepwise, e. first means along one edge of the conveyor to fold all but one of the flaps on one end of the cartons closed, f. article-loading means along the opposite edge of said conveyor downstream from said first flap-folding means and extending transversely to the conveyor and including means to receive articles and powered means to project the same into the other ends of said set up cartons, g. second means along the opposite edge of said conveyor downstream from said article-loading means to fold all but one of the flaps on the opposite end of said cartons closed, h. means to apply adhesive to the remaining unfolded flap on opposite ends of said cartons, i. means to fold said remaining flaps closed simultaneously to seal the articles projected into said cartons by the applied adhesive on said remaining flaps, and j. a logic control system for the power means of said machine operable to control the movement of all movable elements thereof and including safety-sensing means comprising a pair of sensors adjacent said article-loading means above and below the carton respectively operable to sense the presence of the top and bottom panels of the set up cartons as they arrive opposite said article-loading means to insure respectively that a carton is accurately set up and is in loading position opposite said article-loading means and said control system being operable to cause any inaccurately set up carton or a compartment having no carton therein to pass said article-loading means without said means functioning to project articles from said loading means and without stopping the normal advancing movement of said conveyor, thereby avoiding a jam in the operation of the machine.

10. The machine according to claim 9 further including frame members extending upward from said conveyor and supporting hinged plates immediately overlying the remaining unfolded upper flaps of the cartons and comprising said means to fold said remaining flaps to which adhesive has been applied into closed position against said previously folded flaps, said frame members also supporting said means to apply adhesive to said remaining unfolded flaps.

11. The machine according to claim 10 in which said frame members comprise similar posts and supporting for vertical adjustment thereon said hinged plates and power means to move the same to and from flap-folding positions and also supporting said adhesive-applying means, whereby said machine is capable of accommodating a range of sizes of cartons having different vertical dimensions relative to said conveyor.

12. The machine according to claim 11 further including means to apply a date to one of said flaps to which adhesive has been applied and said means also being supported by said frame means for vertical adjustment relative to said conveyor.

13. The machine according to claim 11 in which said conveyor comprises separate parallel endless flexible members extending around said sprockets, said members respectively supporting alternate compartment-forming members perpendicular to said chains and further including means to adjust said chains relative to each other to vary the distance between successive pairs of said compartment-forming members and thereby render said machine capable of operating upon cartons having a range of different widths in a direction parallel to said conveyor.

14. A carton set up and loading machine comprising:

a. a magazine to hold a supply of flat cartons, b. a conveyor having a loading end beneath said magazine extending horizontally therefrom to the discharge end thereof, c. carton set-up means operable to transform said cartons from flat to rectangular shape in cross-section, d. means along one edge of said conveyor to fold the flaps at one end of each carton into folded position to constitute a bottom end of said cartons, e. article-loading means extending transversely from the opposite edge of said conveyor and operable to load articles into the opposite open end of each carton, f. means along said opposite edge of said conveyor operable to fold the flaps of said opposite open end of said carton into closed position, and g. means to advance said conveyor stepwise from the loading end to the discharge end thereof; in combination therewith of the improvement in said article-loading means comprising:

h. guide means to receive articles to be packaged, i. pusher means slidable longitudinally along said guide means in opposite feeding and retracting strokes, j. fluid-operated cylinder means connected to said pusher means and operable to move said means in said opposite strokes, k. said pusher means comprising substantially perpendicular fingers movable vertically relative to said guide means from an inoperative position below said guide means to an operative position above the same, and l. actuating means between said fingers and said cylinder means operable at the commencement of a feed stroke to elevate said fingers vertically to the operative position above said guide means and to retract the same vertically downward to the inoperative position thereof below said guide means at the commencement of each retracting stroke to effect a rectalinear movement of said pusher fingers, thereby permitting additional articles to be deposited upon said guide means while said fingers are retracting to enhance the speed of operation of the machine.

15. The machine according to claim 14 further including plunger means movable along said guide means toward and from the end thereof nearest said conveyor, means above said guide means to deliver articles thereonto at a predetermined location, and means to actuate said plunger means after one delivery of articles to advance the same along said guideway to provide accommodation for further delivery of articles prior to actuation of said pusher fingers to eject all the delivered articles into a carton.

16. The machine according to claim 15 further including a platform movable vertically relative to an opening in said guide means, a vertical fluid-operated cylinder unit connected to said platform to move the same from a level below said guide means to the level thereof to permit said platform initially to successively receive articles to accumulate in a stack thereon and be depressed below said guide means, and control means operable to actuate said cylinder unit when a stack of a predetermined number of articles has been formed to elevate said platform to the level of said guide means and thereby enable said plunger means to push said stack toward the end of said guide means nearest said conveyor.

17. The machine according to claim 14 further including below said guide means rod means parallel thereto, and friction means slidable upon said rod means with resistance and connected to said pusher means, whereby said friction means cause initial resistance to movement of said pusher means while said perpendicular fingers are being elevated above said guide means.

18. The machine according to claim 17 in which said actuating means for said fingers comprise bell crank means pivotally carried by said pusher means, and means connecting said bell crank means between said fingers and said cylinder means to effect elevation of said fingers during initial movement of said cylinder means.

* * * * *